US010923269B2

(12) United States Patent
Forster et al.

(10) Patent No.: US 10,923,269 B2
(45) Date of Patent: Feb. 16, 2021

(54) ARRANGEMENT FOR COMPENSATING DISTURBANCE VOLTAGES INDUCED IN A TRANSFORMER

(71) Applicant: EPCOS AG, Munich (DE)

(72) Inventors: Michael Forster, Erding (DE); Martin Neudecker, Munich (DE)

(73) Assignee: EPCOS AG, München (DE)

( * ) Notice: Subject to any disclaimer, the term of this patent is extended or adjusted under 35 U.S.C. 154(b) by 243 days.

(21) Appl. No.: 15/780,360

(22) PCT Filed: Oct. 13, 2016

(86) PCT No.: PCT/EP2016/074573

§ 371 (c)(1),
(2) Date: May 31, 2018

(87) PCT Pub. No.: WO2017/102134

PCT Pub. Date: Jun. 22, 2017

(65) Prior Publication Data

US 2019/0006086 A1 Jan. 3, 2019

(30) Foreign Application Priority Data

Dec. 18, 2015 (DE) ..... 10 2015 122 244

(51) Int. Cl.

| | |
|---|---|
| ***H01F 17/04*** | (2006.01) |
| ***H01F 27/28*** | (2006.01) |
| ***H01F 27/38*** | (2006.01) |
| ***H01F 27/34*** | (2006.01) |

(52) U.S. Cl.
CPC ..... *H01F 27/289* (2013.01); *H01F 17/04* (2013.01); *H01F 27/34* (2013.01); *H01F 27/38* (2013.01)

(58) Field of Classification Search
USPC ..... 336/84, 221
See application file for complete search history.

(56) References Cited

U.S. PATENT DOCUMENTS

| | | | | |
|---|---|---|---|---|
| 1,724,935 A * | 8/1929 | Huet | H01F 38/085 336/145 |
| 2,406,045 A | 8/1946 | Stevens | |
| 4,079,295 A | 3/1978 | den Hollander | |
| 4,473,811 A | 9/1984 | Schauble | |
| 5,489,884 A | 2/1996 | Heringer et al. | |

(Continued)

FOREIGN PATENT DOCUMENTS

| | | |
|---|---|---|
| DE | 1286208 B | 1/1969 |
| DE | 3238250 C2 | 12/1989 |

(Continued)

*Primary Examiner* — Ronald Hinson
(74) *Attorney, Agent, or Firm* — Slater Matsil, LLP

(57) ABSTRACT

An arrangement for compensating disturbance voltages induced in a transformer is disclosed. In an embodiment an arrangement includes a transformer component comprising a transformer winding and an ancillary apparatus, wherein the ancillary apparatus comprises an auxiliary winding, wherein the auxiliary winding is connected in series with the transformer winding, and wherein the ancillary apparatus is arranged and designed such that an interference voltage induced in the transformer component is reduced by a counter-voltage induced in the ancillary apparatus.

11 Claims, 3 Drawing Sheets

(56) References Cited

U.S. PATENT DOCUMENTS

| | | | | |
|---|---|---|---|---|
| 7,268,658 | B1 * | 9/2007 | Liang | H01F 27/38 336/180 |
| 7,701,315 | B2 | 4/2010 | Mecke et al. | |
| 2002/0163413 | A1 | 11/2002 | Holdahl et al. | |
| 2006/0197511 | A1 | 9/2006 | AF Klercker Alakula | |
| 2010/0066474 | A1 | 3/2010 | Huang et al. | |
| 2013/0234821 | A1 * | 9/2013 | Shim | H01F 27/346 336/84 M |

FOREIGN PATENT DOCUMENTS

| | | | |
|---|---|---|---|
| DE | 102005010342 | A1 | 9/2006 |
| DE | 102010001484 | A1 | 9/2011 |
| DE | 102011115092 | B4 | 10/2014 |
| DE | 102013101364 | A1 | 10/2014 |
| DE | 102013226203 | A1 | 6/2015 |
| JP | S5282011 | A | 7/1977 |
| JP | 61166015 | A | 7/1986 |
| JP | 2005136314 | A | 5/2005 |
| WO | 2006100294 | A1 | 9/2006 |

* cited by examiner

ARRANGEMENT FOR COMPENSATING DISTURBANCE VOLTAGES INDUCED IN A TRANSFORMER

This patent application is a national phase filing under section 371 of PCT/EP2016/074573, filed Oct. 13, 2016, which claims the priority of German patent application 10 2015 122 244.2, filed Dec. 18, 2015, each of which is incorporated herein by reference in its entirety.

TECHNICAL FIELD

The invention relates to an arrangement for electromagnetic interference suppression of a transformer component, which can be used, for example, in the circuit of an ultrasonic echo distance sensor in the automotive sector.

BACKGROUND

Ultrasonic echo distance sensors are used in the automotive sector in parking assistance systems for distance measurement between a vehicle and an object. A circuit of an ultrasonic echo distance sensor can have a transformer component (transformer), with which, in a transmission phase, an AC voltage is transformed to high values, which causes the ultrasonic echo distance sensor temporarily to perform a thickness-mode oscillation. In the reception phase following the transmission phase, the high impedance of the echo signal is transformed by the transformer component into a low impedance that is matched to the reception circuit of the sensor circuit, as a result of which even extremely small signals can be detected by the circuit with low levels of noise. In the reception mode, external interference influences can affect the system, in particular due to inductive action in the transformer.

Interference fields that pass into the toroidal core of the transformer from the outside induce interference voltages in the windings. Instead of using toroidal cores, electrical transformer components having an EP design, for example EP5/EP6 transformers, are generally used in circuits for distance sensors. The residual air gap between the core halves, which is unavoidable in this case, leads to an interference voltage being induced in the windings.

Interference voltages can be generated, for example, by induction due to external magnetic alternating fields (interference fields) in the transformer component. Such alternating fields can be generated, for example, by induction loops in the roadway for vehicle identification.

In accordance with the prior art, the induced interference voltage is reduced by a so-called reduction winding. In this case, an additional winding in the form of a self-contained conductor arranged around the entire core is used. However, this involves a large amount of material, which leads to high production costs of the transformer.

SUMMARY OF THE INVENTION

Embodiments provide an arrangement that compensates for interference voltages induced in the transformer effectively.

According to one aspect, an arrangement for compensating for interference voltages induced in a transformer is specified. In other words, the arrangement is provided and designed to reduce, preferably to completely extinguish, the interference voltages induced in a transformer component. The arrangement has a transformer component. The transformer component is, for example, an EP5/EP6 transformer.

The transformer component preferably has a core having two core halves and a coil former. The coil former has contact elements for the purpose of applying a voltage to the transformer.

The arrangement also has an ancillary apparatus. The ancillary apparatus and the transformer component are preferably connected in series. The ancillary apparatus is arranged and designed in such a way that an interference voltage induced in the transformer component is reduced by a counter-voltage induced in the ancillary apparatus. The induced counter-voltage achieves effective interference suppression of the transformer component in a simple and cost-effective manner.

The transformer component has a transformer winding. The transformer winding has wires of a primary and secondary winding of the transformer. The transformer winding is wound onto a central pipe of the coil former. The ancillary apparatus has an auxiliary winding. The auxiliary winding preferably has a wire. A wire diameter of the auxiliary winding is in this case substantially equal to a wire diameter of the transformer winding. In other words, the auxiliary winding and the transformer winding preferably have the same thickness. Consequently, only a low level of material outlay is required to provide the auxiliary winding. The costs for the arrangement are kept low as a result.

The auxiliary winding may have a winding direction. The winding direction of the auxiliary winding runs in the opposite direction to a winding direction of the transformer winding. In particular, the winding direction of the auxiliary winding runs in the opposite direction to a winding direction of a main transformer winding (primary winding of the transformer). The auxiliary winding is connected in series with the transformer winding. By winding the transformer winding and the auxiliary winding in opposite directions and by electrically connecting the transformer winding and the auxiliary winding in opposing directions, a voltage that is mirror-inverted with respect to an interference voltage induced in the transformer winding can be generated in the auxiliary winding. The counter-voltage generated can reduce, or in the ideal case completely extinguish, the interference voltage effectively. Effective interference suppression of the transformer can therefore be achieved. The specific configuration of the auxiliary winding, for example in the form of a wire, can furthermore achieve interference suppression of the transformer in a particularly cost-effective manner. In particular, by using the auxiliary winding, the level of material outlay is significantly reduced in comparison to the interference suppression solutions from the prior art, which leads to a substantial reduction in costs.

The auxiliary winding may have at least one coil. However, the number of coils of the auxiliary winding can also deviate significantly from one coil. For example, the auxiliary winding can have two, three, four, five, ten, 20 or 30 coils. A number of coils of the auxiliary winding is in this case preferably matched to a number of coils of the transformer winding. The more coils the transformer winding has, the more coils the auxiliary winding also has. A ratio of the number of coils of the auxiliary winding to a number of coils of the transformer winding is typically 1:10. For the compensation of the interference voltage, in particular, an optimum ratio of the number of coils of the auxiliary winding to the number of coils of the main transformer winding of typically 1:10 has become apparent.

The counter-voltage generated in the auxiliary winding may have a similar magnitude, preferably the same magnitude, to the interference voltage. The counter-voltage is preferably furthermore phase-shifted by 180° in comparison to the interference voltage. Complete extinguishing of the interference voltage in the transformer can be achieved as a result.

In accordance with an exemplary embodiment, the auxiliary winding is arranged around the transformer component. The auxiliary winding is preferably guided at least around an outer region of the transformer. The auxiliary winding can also be guided around the transformer winding. Consequently, at least some of the auxiliary winding can also run inside the transformer component, in particular inside the core. In particular, the auxiliary winding can be wound around the transformer component in the shape of an 8. In this case, the auxiliary winding can be electrically connected by means of a contact element of the transformer component. The transformer component and the ancillary apparatus in this case utilize a common contact element for the purpose of electrical contact-connection. In particular, the auxiliary winding is not intrinsically shorted.

In accordance with an exemplary embodiment, the transformer component has a core having two core halves, wherein a first core half has a central limb and an outer limb, and wherein a further core half has a central limb and an outer limb. The auxiliary winding is wound around one or both outer limbs of the core. In particular, the auxiliary winding is guided only around a partial region of the transformer component. The transformer winding or an inner region of the transformer component is free of the auxiliary winding. In this case, too, the auxiliary winding can be electrically connected by means of a contact element of the transformer component.

Such an arrangement of the auxiliary winding has advantages in terms of transformer manufacture and advantages in terms of signal technology. Further designs for the transformer can also be included or realized.

In accordance with an exemplary embodiment, the transformer component and the ancillary apparatus represent discrete or physically separate component parts of the arrangement. In this case, the ancillary apparatus and, in particular, the auxiliary winding are not arranged around at least a partial region of the transformer component. Instead, the transformer component and the ancillary apparatus are arranged separately. The ancillary apparatus has a core, in particular a cylinder core. The core can be a ferrite core. The auxiliary winding is arranged around the core of the ancillary apparatus. In this case, too, the winding direction of the auxiliary winding is in the opposite direction to the winding direction of the transformer winding. The auxiliary winding is electrically connected, for example, by means of a separate contact element of a printed circuit board. In particular, the transformer component and the ancillary apparatus do not utilize a common contact element for the purpose of electrical contact-connection in this case.

A corresponding arrangement has the advantage that existing transformer designs and existing ancillary elements can be used. Design modifications in the case of present components are therefore redundant.

A corresponding arrangement also has advantages in terms of manufacturing technology when the ancillary apparatus (auxiliary winding) in the transformer component is not possible.

This arrangement also affords the advantage that the interference field can be detected in a manner separated from the main component (transformer) in targeted fashion.

In accordance with an exemplary embodiment, the arrangement can be applied to transformers and transducers of all types. In particular, in addition to the described use for interference suppression in the receiving case/irradiating case, an analogous use in the transmitting case/emitting case is also conceivable with the aim of reducing interference emission.

The arrangement is described in more detail below with reference to exemplary embodiments and the associated figures.

BRIEF DESCRIPTION OF THE DRAWINGS

The drawings described below are not to be understood as being true to scale. Instead, individual dimensions can be illustrated in an enlarged, reduced or even distorted manner for the purpose of better illustration.

Elements that are identical to one another or that perform the same function are denoted by identical reference signs.

DETAILED DESCRIPTION OF ILLUSTRATIVE EMBODIMENTS

Figure 1A:
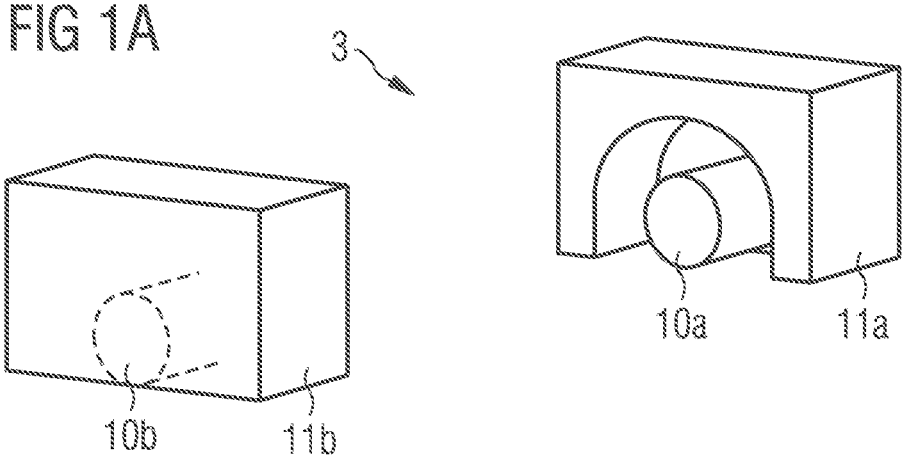
FIG. 1A shows core halves of an EP transformer.

FIG. 1A shows an embodiment of a core 3 for an EP transformer. The core 3 comprises two core halves 3*a*, 3*b*, wherein a first core half 3*a* has a central limb 10*a* and an outer limb 11*a*. A further core half 3*b* has a central limb 10*b* and an outer limb 11*b*.

Figure 1B:
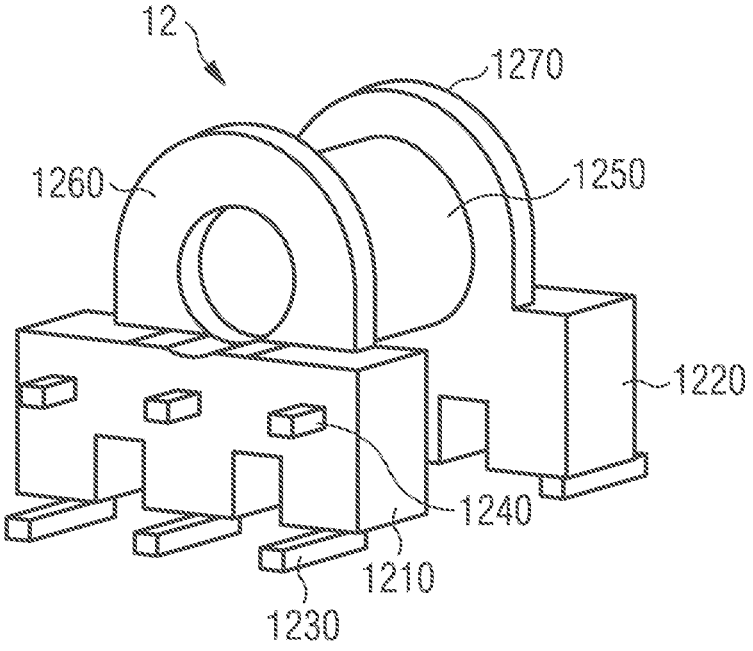
FIG. 1B shows a coil former for an EP transformer.

FIG. 1B shows a coil former 12 for the EP transformer. The coil former 12 has a contact-connection device 1210 and a contact-connection device 1220. Contact elements 1230 are located on the contact-connection devices 1210, 1220 for the purpose of applying a voltage to wires (not shown in FIG. 1*b*) of a primary and secondary winding of the transformer (consolidated in the following text as transformer winding 1280; see FIG. 1C, for example), which wires can be wound onto a central pipe 1250 of the coil former 12. The primary winding of the transformer is also referred to as the main transformer winding. FIG. 1D shows the winding direction 1281 of the main transformer winding for an EP transformer.

Contact elements 1240 serve for terminating the wires and are connected inside the contact-connection devices 1210, 1220 to the contact elements 1230. The coil former 12 has side parts/flanges 1260, 1270 on the two ends of the central pipe 1250. The side parts 1260, 1270 prevent the separate wires of the primary and secondary winding wound onto the central pipe 1250 from being able to laterally slide off the central pipe 1250.

After the central pipe 1250 of the coil former 12 has been wound with the primary and secondary winding (transformer winding 1280), the two core halves 3*a*, 3*b* are inserted with their central limbs 10*a*, 10*b* into the hollow space of the central pipe 1250. The two outer limbs 11*a*, 11*b* can be adhesively bonded to one another, for example. The finished EP transformer therefore has two half-shell-shaped cores 3*a*, 3*b*, for example made of ferrite, which are embodied in a mirror-symmetrical manner to one another and have central limbs 10*a*, 10*b* that are connected to one another. The wires of the primary and secondary winding are located on the coil former 12 in wound form inside the half-shell-shaped cores 3*a*, 3*b*.

Owing to the two-part half-shell core 3*a*, 3*b*, magnetic interference fields are guided to a not insignificant extent from the ferrite material directly through the central limb 10*a*, 10*b*. The air gap of the core 3 is smoothed in one of the two central limbs 10*a*, 10*b*, but the unavoidable residual air gap at the outer limb 11*a*, 11*b* results in the magnetic resistance at the outer limb 11*a*, 11*b* only being less than that of the central limb 10*a*, 10*b* by 10 to 50 times and therefore magnetic interference fields are guided partially through the central limb 10*a*, 10*b* and an interference voltage is induced in the transformer winding 1280.

Figure 1C:
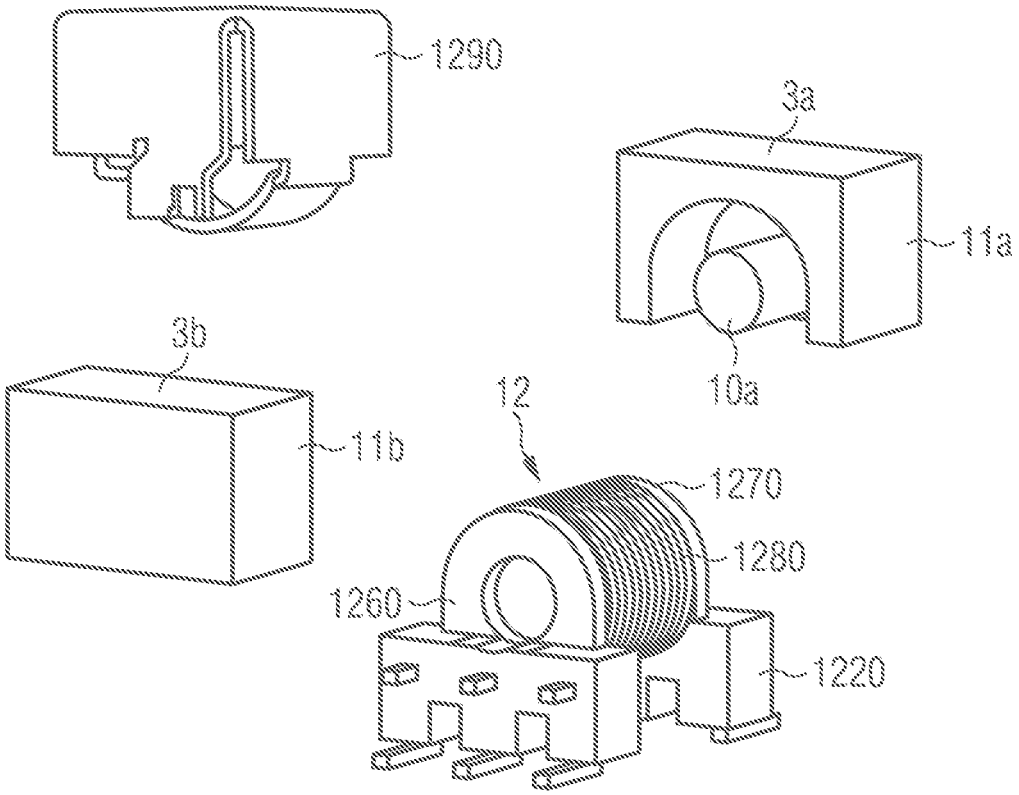
FIG 1C (Prior Art)
FIG. 1C shows a EP transformer having a reduction winding in accordance with the prior art.
Figure 1D:
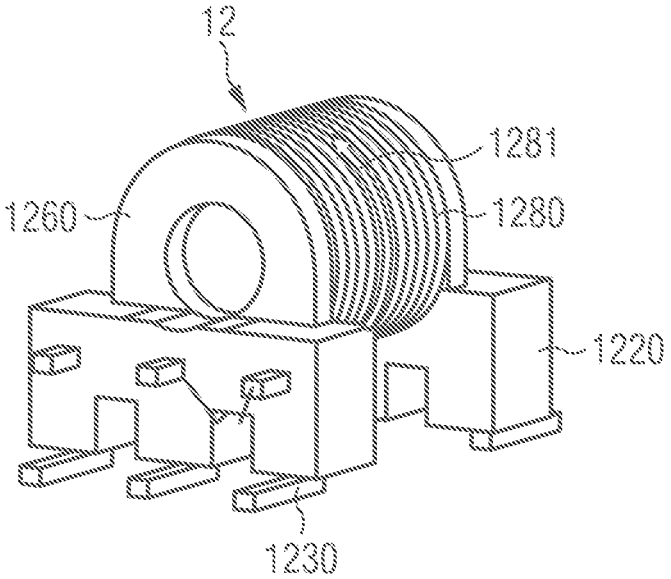
FIG. 1D schematically shows the direction of a main transformer winding around a coil former for an EP transformer.

FIG. 1C shows an EP transformer having a reduction winding in accordance with the prior art. To reduce induction voltages due to external magnetic interference fields, an additional squirrel cage winding/reduction winding 1290 is used in the EP transformer. In this case, a self-contained electrical conductor is arranged (reduction winding 1290; top of FIG. 1C) around the entire core 3 (central limb 10*a*, 10*b* and outer limb 11*a*, 11*b*). The winding plane of the reduction winding 1290, which only has a single coil, is in this case typically arranged in parallel with the winding plane of the transformer winding 1280 (see bottom of FIG. 1C).

In this case, the squirrel cage winding 1290 has to be as low-resistance as possible. This is associated with a significant amount of material, which leads to high production costs.

Figure 2:
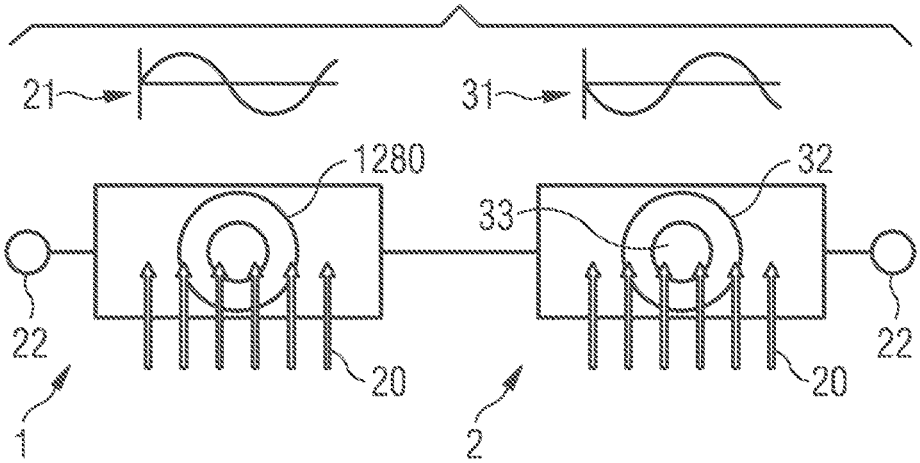
FIG. 2 shows an arrangement for compensating for interference voltages in the transformer in accordance with a first exemplary embodiment.

FIG. 2 shows an arrangement according to embodiments of the invention for compensating for interference voltages in a transformer 1.

The arrangement has a transformer 1 (transformer component 1). The transformer 1 substantially corresponds to the transformer described in connection with FIGS. 1A and 1B. In particular, the transformer 1 has the coil former 12 having the transformer winding (wires of a primary and secondary winding) 1280 and two half-shell-shaped ferrite cores 3*a*, 3*b*, which are embodied in a mirror-symmetrical manner to one another and have central limbs 10*a*, 10*b* (see FIG. 1A) that are connected to one another. FIG. 2 also illustrates an external interference field (magnetic field) 20 and an interference voltage 21 induced in the transformer 1 by the interference field 20.

The arrangement also has an ancillary apparatus 2. The ancillary apparatus 2 has an auxiliary winding 32 (see also FIGS. 2 to 4). The auxiliary winding 32 can have, for example, a wire, for example a copper wire. Alternatively, it can also be an aluminum wire or a steel wire.

In contrast to the reduction winding 1290 in accordance with the prior art, the auxiliary winding 32 has a thinner conductor. A diameter of the auxiliary winding 32 preferably deviates only slightly from a diameter of the transformer winding 1280. The auxiliary winding 32 and the transformer winding 1280 preferably have an identical or an at least similar wire thickness. For example, the auxiliary winding 32 has a wire diameter of 40 μm to 150 μm. The transformer winding 1280 and the auxiliary winding 32 are wound counter to one another. In contrast to the reduction winding 1290 from the prior art, the auxiliary winding 32 is also not intrinsically shorted. Instead, the auxiliary winding 32 is connected by means of separate contact points. In particular, the auxiliary winding 32 is conductively connected to contact points, as is explained in more detail in the following text.

Figure 3:
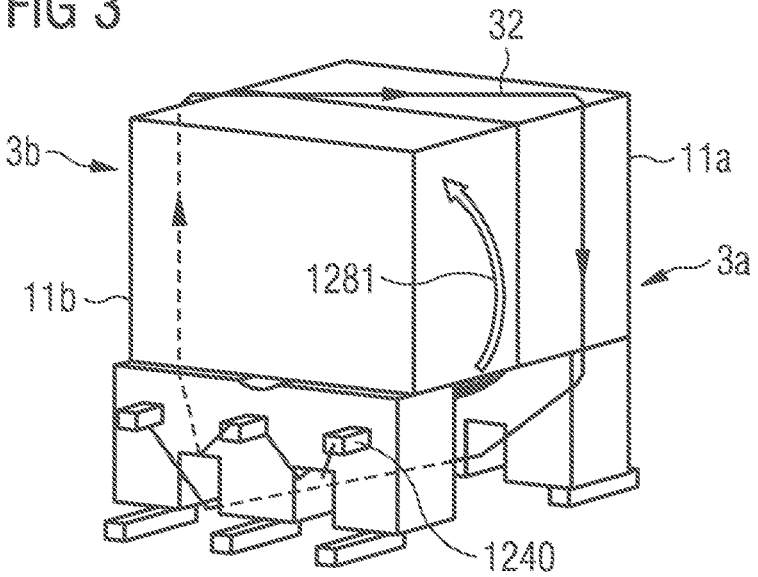
FIG. 3 schematically shows the profile of the auxiliary winding around a transformer, which is directed counter to the main transformer winding, in accordance with an exemplary embodiment.
Figure 4:
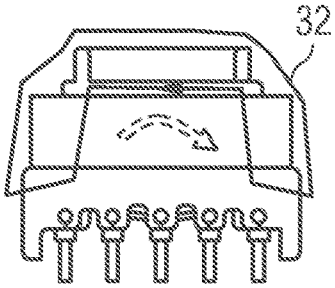
FIG. 4 schematically shows the profile of the auxiliary winding 32 around the transformer in accordance with a further exemplary embodiment.

In the exemplary embodiments shown in FIGS. 2, 3 and 4, the auxiliary winding 32 has just one coil. However, the auxiliary winding 32 can also have a plurality of coils. The auxiliary winding 32 preferably has one to 30 coils, for example 5, 10, 20 or 25 coils. A number of the coils of the auxiliary winding 32 is matched to a number of the coils of the transformer winding 1280. The ratio of the number of coils of the auxiliary winding 32 and the transformer winding 1280 is preferably 1:10.

The auxiliary winding 32 is connected in series with the transformer winding 1280 (see FIG. 2, for example). The auxiliary winding 32 and the transformer 1 are connected, in particular, in such a way that an interference voltage 21 (see FIG. 2) coupled into the transformer 1 is suppressed by virtue of a voltage 31 induced in the auxiliary winding 32 being connected in series with the transformer winding 1280. The voltage 31 induced in the auxiliary winding 32 is preferably mirror-inverted with respect to the interference voltage 21. The mirror-inverted voltage 31 is preferably of equal magnitude to the interference voltage 21. The mirror-inverted voltage 31 is preferably phase-offset by 180° in comparison to the interference voltage 21.

Consequently, a voltage 31, which is mirror-inverted with respect to the interference voltage 21, is induced in the auxiliary winding 32 due to the interference field 20. The mirror-inverted voltage 31 reduces the interference voltage 21 induced in the transformer winding 1280. The interference voltage 21 is preferably completely extinguished by the mirror-inverted voltage 31. Consequently, a voltage of zero is applied to the terminals 22 of the arrangement composed of the transformer 1 and the ancillary apparatus 2 connected in series, even in the presence of an external magnetic interference field 20.

In the exemplary embodiment shown in FIG. 2, the transformer 1 and the ancillary apparatus 2 represent discrete component parts or component parts arranged separately from one another. To this end, the ancillary apparatus 2 has a core 33, for example a ferrite core. The auxiliary winding 32 is arranged around the core 33. The auxiliary winding 32 is connected here by means of a printed circuit board (not illustrated in FIG. 2). The winding direction of the auxiliary winding 32 around the core 33 is in the opposite direction to a winding direction of the transformer winding 1280. In particular, the winding direction of the auxiliary winding 32 around the core 33 is in the opposite direction to a winding direction 1281 of the main transformer winding (see also FIG. 3 in this respect).

FIG. 3 schematically shows the profile of the auxiliary winding 32 around the coil former 12 in accordance with a further exemplary embodiment. Like in the arrangement shown in FIG. 2, the auxiliary winding 32 runs in the opposite direction to the transformer winding 1280 (see winding direction 1281 of the main transformer winding in FIG. 3). However, unlike in FIG. 2, the auxiliary winding 32 is not arranged around a separate core. In this exemplary embodiment, the auxiliary winding is guided around the transformer winding 1280. The transformer 1 and the ancillary apparatus 2 consequently represent a common component part of the arrangement. In particular, the transformer 1 and the ancillary apparatus 2 are in this case not spatially separate from one another. The auxiliary winding 32 also runs past the contact elements 1240 of the transformer 1 and is connected thereto.

The auxiliary winding 32 runs not only around the transformer winding 1280, but also around the entire transformer 1. The auxiliary winding 32 preferably runs at the position of the reduction winding 1290 described in connection with FIG. 1C. The auxiliary winding 32 is arranged around the entire core 3 (central limb 10*a*, 10*b* and outer limb 11*a*, 11*b*). The auxiliary winding 32 is fed through underneath the core 3 and electrically conductively connected to the contact elements 1240.

FIG. 4 schematically shows the profile of the auxiliary winding 32 around the transformer 1 in accordance with a further embodiment. The auxiliary winding 32 is in this case wound only around one or both outer limbs 11*a*, 11*b* of the transformer 1. In particular, in this exemplary embodiment, the auxiliary winding 32 is not guided around the transformer winding 1280. Instead, the auxiliary winding 32 is merely wound around an outer region of the transformer 1.

Although only a restricted number of possible developments of the invention could be described in the exemplary embodiments, the invention is not restricted thereto. It is possible, in principle, to use a different number of coils or to arrange the elements in an offset position from one another.

The description of the subjects specified here is not limited to the individual specific embodiments. Rather, the features of the individual embodiments—insofar as it makes technical sense—can be combined with one another arbitrarily.

The invention claimed is:

1. An arrangement for compensating for interference voltages induced in a linear single-phase transformer for signal transmission, the arrangement comprising:

a linear single-phase transformer for signal transmission comprising:

a core comprising two core halves, wherein a first core half comprises a central limb and an outer limb and a second core half comprises a central limb and an outer limb; and a coil former with a central pipe and a transformer winding with a primary and a secondary winding arranged on the central pipe, wherein the central limbs of the first core half and the second core half are arranged in a hollow space of the central pipe and wherein between the outer limbs of the first core half and the second core half a residual air gap is located which supports an inducement of an interference voltage into the transformer winding; and an ancillary apparatus comprising an auxiliary winding, wherein the auxiliary winding is connected in series with the primary winding of the transformer winding, and wherein the ancillary apparatus is arranged and designed in such a way that an interference voltage induced into the transformer winding of the single-phase transformer is reduced by a counter-voltage induced in the ancillary apparatus;

wherein the auxiliary winding comprises a winding direction, and wherein the winding direction of the auxiliary winding runs in the opposite direction to a winding direction of the primary winding of the transformer winding; and wherein the auxiliary winding is arranged around the single-phase transformer.

2. The arrangement according to claim 1, wherein the auxiliary winding comprises at least one coil.

3. The arrangement according to claim 1, wherein a ratio of a number of coils of the auxiliary winding to a number of coils of the transformer winding is 1:10.

4. The arrangement according to claim 1, wherein the counter-voltage has the same magnitude as the interference voltage.

5. The arrangement according to claim 1, wherein the counter-voltage is phase-shifted by 180° in comparison to the interference voltage.

6. The arrangement according to claim 1, wherein the interference voltage is completely extinguished by the counter-voltage.

7. The arrangement according to claim 1, wherein the auxiliary winding comprises a wire.

8. The arrangement according to claim 1, wherein the ancillary apparatus is electrically conductively connected to a contact element of the single-phase transformer component or to a separate contact element.

9. An arrangement for compensating for interference voltages induced in a linear single-phase transformer for signal transmission, the arrangement comprising:

a linear single-phase transformer component for signal transmission comprising:

a core comprising two core halves, wherein a first core half comprises a central limb and an outer limb and a second core half comprises a central limb and an outer limb; and a coil former with a central pipe and a transformer winding with a primary and a secondary winding arranged on the central pipe, wherein the central limbs of the first core half and the second core half are arranged in a hollow space of the central pipe and wherein between the outer limbs of the first core half and the second core half a residual air gap is located which supports an inducement of an interference voltage into the transformer winding; and an ancillary apparatus, comprising an auxiliary winding, wherein the auxiliary winding is connected in series with the primary winding of the transformer winding;

wherein the ancillary apparatus is arranged and designed in such a way that an interference voltage induced into the transformer winding of the single-phase transformer component is reduced by a counter-voltage induced in the ancillary apparatus;

wherein the auxiliary winding comprises a winding direction, and wherein the winding direction of the auxiliary winding runs in the opposite direction to a winding direction of the primary winding of the transformer winding; and wherein the single-phase transformer component and the ancillary apparatus represent separate component parts of the arrangement, wherein the ancillary apparatus comprises a core, and wherein the auxiliary winding is arranged around the core of the ancillary apparatus.

10. An arrangement for compensating for interference voltages induced in a linear single-phase transformer for signal transmission, the arrangement comprising:

a linear single-phase transformer component for signal transmission, comprising:

a core comprising two core halves, wherein a first core half comprises a central limb and an outer limb and a second core half comprises a central limb and an outer limb; and a coil former with a central pipe and a transformer winding with a primary and a secondary winding arranged on the central pipe, wherein the central limbs of the first core half and the second core half are arranged in a hollow space of the central pipe and wherein between the outer limbs of the first core half and the second core half a residual air gap is located which supports an inducement of an interference voltage into the transformer winding; and an ancillary apparatus, comprising an auxiliary winding, wherein the auxiliary winding is connected in series with the primary winding of the transformer winding;

wherein the ancillary apparatus is arranged and designed in such a way that an interference voltage induced into the transformer winding of the single-phase transformer component is reduced by a counter-voltage induced in the ancillary apparatus;

wherein the auxiliary winding comprises a winding direction, and wherein the winding direction of the auxiliary winding runs in the opposite direction to a winding direction of the primary winding of the transformer winding; and wherein the auxiliary winding is wound around at least one outer limb of the core.

11. An arrangement for compensating for interference voltages induced in a linear single-phase transformer for signal transmission, the arrangement comprising:

a linear single-phase transformer component for signal transmission, comprising:

a core comprising two core halves, wherein a first core half comprises a central limb and an outer limb, and a second core half comprises a central limb and an outer limb; and a coil former with a central pipe and a transformer winding with a primary and a secondary winding arranged on the central pipe, wherein the central limbs of the first core half and the second core half are arranged in a hollow space of the central pipe and wherein between the outer limbs of the first core half and the second core half a residual air gap is located which supports an inducement of an interference voltage into the transformer winding; and an ancillary apparatus, comprising an auxiliary winding, wherein the auxiliary winding is connected in series with the primary winding of the transformer winding;

wherein the ancillary apparatus is arranged and designed in such a way that an interference voltage induced into the transformer winding of the single-phase transformer component is reduced by a counter-voltage induced in the ancillary apparatus; and wherein the auxiliary winding comprises a winding direction, and wherein the winding direction of the auxiliary winding runs in the opposite direction to a winding direction of the primary winding of the transformer winding; and wherein the counter-voltage has the same magnitude as the interference voltage.

* * * * *